US005615787A

United States Patent [19]

Morris, Sr.

[11] Patent Number: 5,615,787

[45] Date of Patent: Apr. 1, 1997

[54] CONDITION INDICATING CHILD-RESISTANT CLOSURE

[76] Inventor: Glenn H. Morris, Sr., 1192 Cumberland Rd., Chattanooga, Tenn. 37419

[21] Appl. No.: 510,266

[22] Filed: Aug. 2, 1995

[51] Int. Cl.[6] ..... A61J 1/03; B65D 41/04; B65D 55/02

[52] U.S. Cl. ..... 215/217; 215/203; 215/220; 215/301

[58] Field of Search ..... 215/217, 218, 215/206, 223, 201, 203, 208, 219, 220, 221, 301

[56] References Cited

U.S. PATENT DOCUMENTS

| | | | |
|---|---|---|---|
| 3,828,961 | 8/1974 | Lewis | 215/223 |
| 3,843,006 | 10/1974 | Naito et al. | 215/9 |
| 3,912,073 | 10/1975 | Lewis | 206/1.5 |
| 4,690,292 | 9/1987 | Henning | 215/201 |
| 4,832,218 | 5/1989 | Gibilisco | 215/220 |
| 4,998,632 | 3/1991 | Morris, Sr. | 215/201 |

FOREIGN PATENT DOCUMENTS

| | | | |
|---|---|---|---|
| 0528561 | 2/1993 | European Pat. Off. | 215/217 |
| 2260534 | 4/1993 | United Kingdom | 215/217 |

*Primary Examiner*—Allan N. Shoap
*Assistant Examiner*—Niki M. Kopsidas

[57] ABSTRACT

A condition indicating child-resistant closure having an inner cap captivated within an outer cap wherein the caps are freely rotatable relative to each other when the closure is in the child-resistant mode, and are interconnected to each other for removal from a container when the closure is in the non-child-resistant mode. An indicating post is connected to the top wall of the inner cap and is adapted to be contained wholly within a space between the inner and outer caps and therefore not visible when the closure is in the child-resistant mode, the post being extendable through the top wall of the outer cap and therefore visible when the closure is in the non-child-resistant mode. A bridge member is rotatably mounted on the post and moveable between a first position to prevent the inner and outer caps from being interconnected for removal from the container, and a second position permitting the manipulation of the outer cap relative to the inner cap for interconnecting the inner and outer caps for removal of the closure from the container.

11 Claims, 3 Drawing Sheets

CONDITION INDICATING CHILD-RESISTANT CLOSURE

BACKGROUND OF THE INVENTION

A condition indicating child-resistant closure is disclosed in Applicant's U.S. Pat. No. 4,998,632, wherein an inner cap is adapted to be threadably mounted on a container and an outer cap is freely rotatable on the inner cap and normally spring biased upwardly in spaced relationship to the inner cap, but axially movable downwardly and rotatable relative to the inner cap, whereby the inner and outer caps can be interconnected for removal of the closure from the container. An indicating post is mounted on the top wall of the inner cap and is adapted to extend through an aperture in the top wall of the outer cap when the inner and outer caps are interconnected for removal from the closure, to thereby indicate the non-child-resistant mode of the cap assembly. When the outer cap is biased upwardly, the indicated post is positioned in the space between the inner and outer caps and therefore not visible, to thereby indicate the child-resistant mode of the closure.

The condition indicating child-resistant closure of the present invention is of the type disclosed in the above-mentioned patent and is an improvement thereon by eliminating the intricately molded plastic parts, such as the ramps and ramp lips, and constructing and arranging the components of the closure with more simply molded parts, and to render it more user-friendly for adults.

SUMMARY OF THE INVENTION

The condition indicating child-resistant closure of the present invention comprises, essentially, a three component assembly including an inner cap having a recessed top wall and a vertically extending indicating post integral therewith and adapted to extend through an aperture in the top wall of an outer cap freely rotatable on the inner cap. A bridge member is positioned in the recess of the inner cap top wall and freely rotatable on the indicating post between a first position prohibiting the inner and outer caps from being interconnected for removal from the container, and a second position permitting the manipulation of the outer cap relative to the inner cap for interconnecting the inner and outer caps for removal of the closure from the container. Depending flexible fingers are integral with the inner surface of the top wall of the outer cap and are adapted to engage the bridge member for moving the bridge member alternately between the two positions. Diametrically disposed stop members are integral with the top wall of the inner cap and extend upwardly therefrom and are engageable with the bridge member to limit its rotary movement between the two positions. A coil spring is mounted in coaxial relationship with the indicating post and is positioned between the bridge member and the inner surface of the top wall of the outer cap, whereby the outer cap is biased outwardly relative to the inner cap, and the indicating post is contained in the space between the inner and outer caps.

The inner and outer caps are interconnected for removing the closure from the container by a pair of circumferentially spaced, radially inwardly extending lugs integral with the inner surface of the skirt portion of the outer cap cooperating with circumferentially spaced axially extending slots communicating with respective circumferentially extending slots formed in the skirt portion of the inner cap.

Depending leg members are integral with the inner surface of the top wall of the outer cap and engage the bridge member when it has been rotated to the first position to prevent axial movement of the outer cap relative to the inner cap for engagement of the lugs with the slots. The depending leg members being free of the bridge member when the bridge member has been rotated to the second position, thereby allowing the lugs to enter the slots for the connection of the inner cap with the outer cap.

DESCRIPTION OF THE PREFERRED EMBODIMENT

Figure 1:
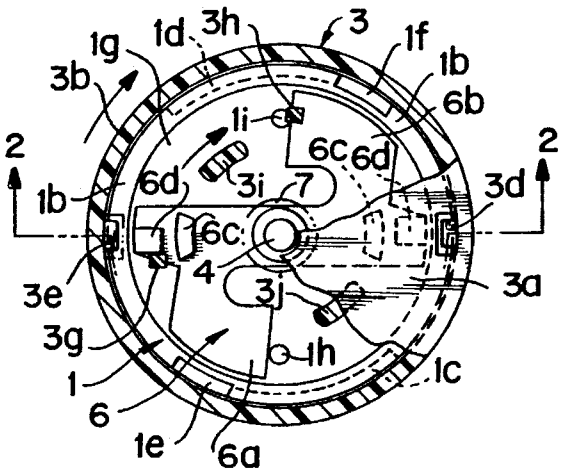
FIG. 1 is a transverse cross-sectional view, partly in top plan, taken substantially along line 1—1 of FIG. 2, showing the outer cap partly in cross-section, the locking lugs and the closure being in the child-resistant position, and the outer cap positioned to turn clockwise to move the bridge member clockwise away from one of the stop members.
Figure 2:
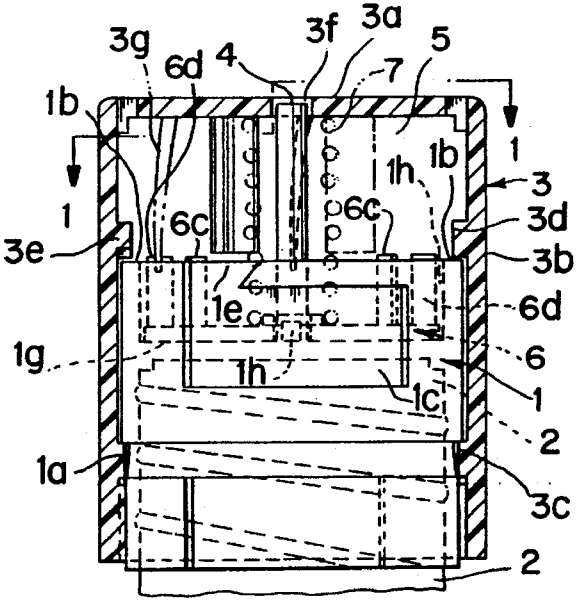
FIG. 2 is a side view of the child-resistant closure of the invention, showing the inner cap in side elevation and the outer cap in cross-section, the view being taken substantially along arcuate line 2—2 of FIG. 1.

Referring to the drawings, and more particularly to FIGS. 1 and 2, the condition indicating child-resistant closure of the present invention comprises an inner cap 1, adapted to be threadably mounted on the neck 2 of a medicine bottle, and an outer cap 3 having a top wall 3*a* and a depending side wall forming a skirt 3*b* having, at its lower end, an inwardly extending annular bead 3*c* engageable with a similarly configured shoulder 1*a* provided on the outer wall surface of the inner cap 1, whereby the inner and outer caps 1 and 3 are interconnected and freely rotatable relative to each other.

The outer cap 3 is provided with a pair of radially inwardly extending, diametrically opposed lugs 3*d*, 3*e* formed on the inner wall surface of the skirt 3*b* of the outer cap 3 and engageable with a peripheral edge portion 1*b* provided on the top of the inner cap 1, whereby the outer cap 3 is held upwardly in spaced relationship to the inner cap 1, and the closure is in a child-resistant mode, wherein the outer cap 3 is freely rotatable on the inner cap 1.

The side wall of the inner cap 1 is provided with a pair of circumferentially extending slots 1*c* and 1*d*, each of which communicate at one end thereof with an upwardly inclined axially extending slot 1*e*, and 1*f*, respectively.

Figure 4:
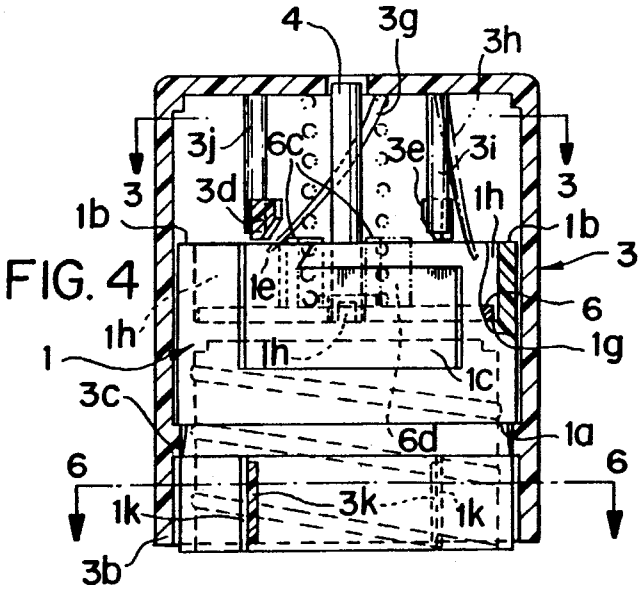
FIG. 4 is a side view similar to FIG. 2, taken substantially along arcuate line 4—4 of FIG. 3, with the elements in position for manipulating the closure to the non-child-resistant position.
Figure 9:
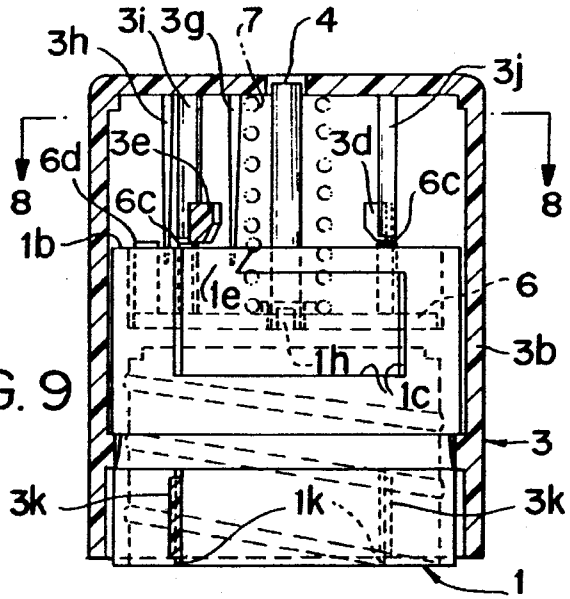
FIG. 9 is a side view similar to FIG. 4, taken substantially along arcuate line 9—9 of FIG. 8, and showing the feet on the outer cap and the bridge member in registration to prevent manipulation of the outer cap to the non-child-resistant position.
Figure 6:
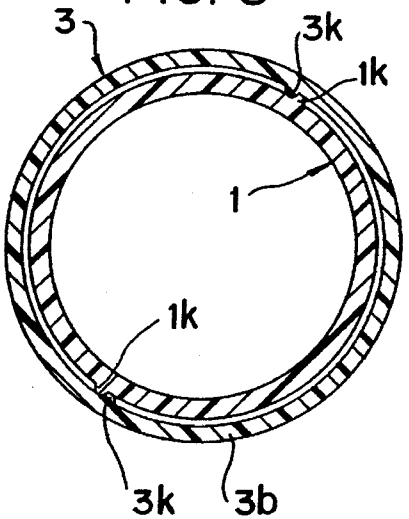
FIG. 6 is a transverse cross-sectional view taken substantially along line 6—6 of FIG. 4, showing the inner and outer cap stop elements in alignment.

A vertically extending indicating post 4 is fixedly mounted on the inner top cap wall 1*g* which is positioned below the peripheral edge portion 1*b*, to thereby provide a recess 1*h* in the top of the inner cap 1. The post 4 is in alignment with an opening 3*f* provided in the top wall of the outer cap 3, whereby when the closure is in the child-resistant mode, the post 4 is positioned within the space 5 between the top wall 1*g* of the inner cap 1 and the top wall 3*a* of the outer cap 3 and below the top of opening 3*f*, and, therefore, not visible outside of the closure, to thereby indicate the child-resistant mode of the closure, as shown in FIGS. 2, 4 and 9. The post 4 is adapted to extend through the opening 3*f* in the outer cap 3 and above the top wall 3*a* thereof, when the outer cap 3 has been moved inwardly to an interlocked position with the inner cap 1, to be described more fully hereinafter, and therefore visible outside the closure, to thereby indicate the non-child-resistant mode of the closure, as shown in FIG. 5.

Figure 8:
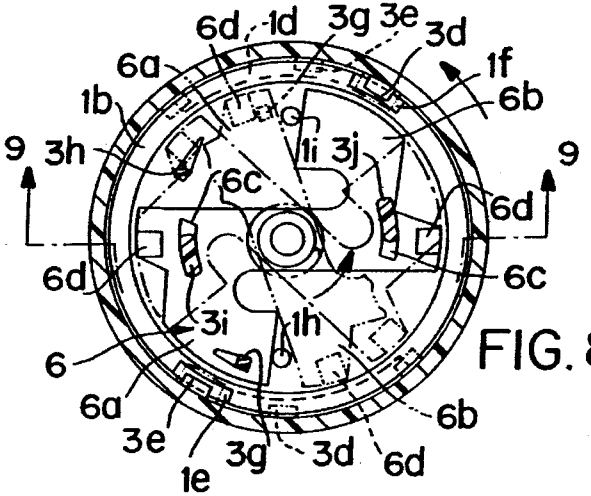
FIG. 8 is a transverse cross-sectional view similar to FIG. 3 showing the bridge member in phantom lines being rotated counter-clockwise into its stops as shown in full lines, by counter-clockwise rotation of the outer cap positioning the bridge member to block the closure from being manipulated to the non-child-resistant position when the locking lugs are in position for manipulation to the non-child-resistant position, the view taken substantially along line 8—8 of FIG. 9.
Figure 5:
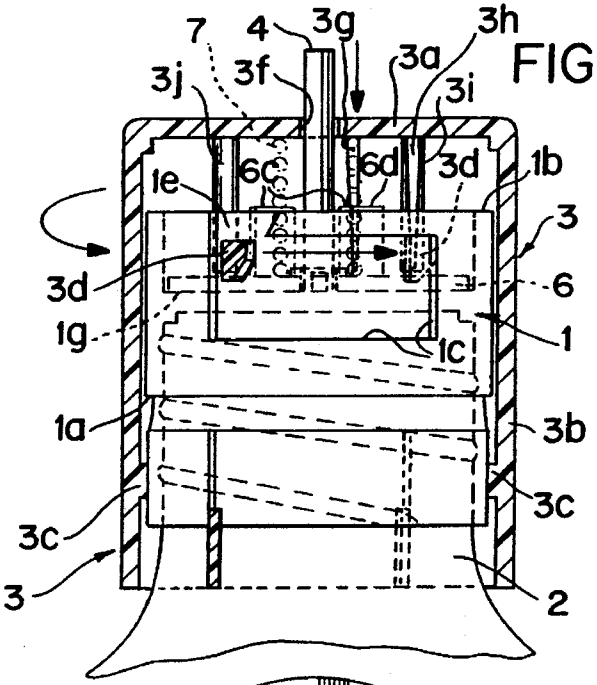
FIG. 5 is a side view similar to FIG. 4 showing the closure being manipulated to the non-child-resistant position, as indicated by the phantom line showing of the locking lug with the warning indicator protruding from the top of the outer cap.
Figure 7:
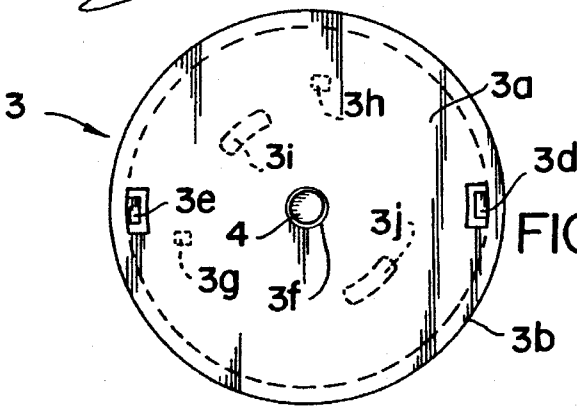
FIG. 7 is a top plan view of the condition indicating child-resistant closure showing the feet which depend from the inner top wall of the outer cap in dotted lines.
Figure 10:
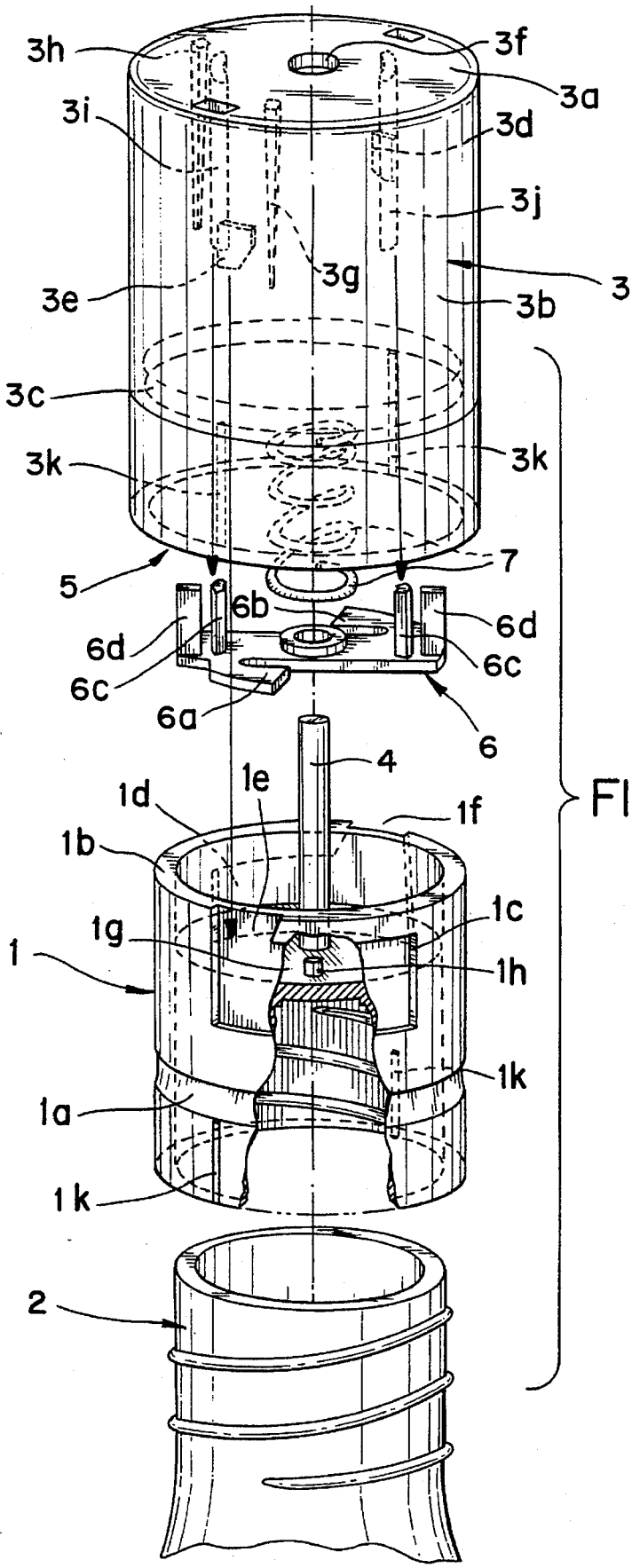
FIG. 10 is an exploded perspective view of the closure showing the elements thereof in the positions shown in FIGS. 8 and 9.

A bridge member 6 is supported on the top wall 1*g* of the inner cap 1 and is freely rotatable on the indicating post 4, and a coil spring 7 is positioned in coaxial relationship with the indicating post 4 and mounted between the bridge member 6 and the top wall 3*a* of the outer cap 3 to provide an upwardly biasing force to the outer cap lugs 3*d* and 3*e* within their respective circumferential slots 1*c* and 1*d*, as shown in FIG. 5. The bridge member 6 comprises a rotor having oppositely extending vane portions 6*a*, 6*b* having integral upwardly extending radially spaced posts 6*c*, 6*d*. A pair of flexible fingers 3*g* and 3*h* are integral with and depend from the top wall 3*a* of the outer cap 3 and are adapted to engage the posts 6*d* for rotating the bridge member 6 alternately between stop members 1*h* and 1*i* integral with, and extending upwardly from, the top wall 1*g* of the inner cap 1. A pair of depending leg members 3*i* and 3*j* are also integral with the top wall 3*a* of the outer cap 3 and are adapted to become axially aligned with the posts 6*c* when the outer cap 3 has been rotated in a counter-clockwise direction and the lugs 3*d* and 3*e* in the outer cap 3 are aligned with the axial extending slots 1*e* and 1*f* on the inner cap. The posts 6*c* and depending leg members 3*i* and 3*j* are located on the same radius from indicating post 4, and posts 6*d* and flexible fingers 3*g* and 3*h* are located on the same spaced radius from indicating post 4. The terminal ends of the depending leg members 3*i* and 3*j* are spaced slightly above the upper terminal ends of posts 6*c* so that they pass each other during normal rotation of outer cap 3 on inner cap 1. The counter-clockwise movement of the outer cap 3 also results in a counter-clockwise movement of the bridge member 6 by flexible finger 3*g* engaging post 6*d*, as shown in phantom lines in FIG. 8, so that the vanes 6*a* and 6*b* abut the stop members 1*h* and 1*i* on opposite sides thereof, as shown in full lines in FIG. 8. When bridge member 6 is first moved to the full line position of FIG. 8, lugs 3*d* and 3*e* on the outer cap are still in a position supported on the upper peripheral edge 1*b* of the inner cap 1 so that the outer cap 3 cannot be pushed downwardly. With further counter-clockwise rotation of outer cap 3 the flexible fingers 3*g* and 3*h* flex and snap over the tops of posts 6*d* until lugs 3*d* and 3*e* are aligned with the axial extending slots 1*e* and 1*f* on the inner cap, as shown in full lines in FIGS. 8 and 9. If an attempt is made to push the outer cap 3 downwardly at this point, the lower terminal ends of the depending leg members 3*i* and 3*j* will abut the upper terminal ends of the posts 6*c* to thus create a bridge to prevent outer cap lugs 3*d* and 3*e* from entering axial slots 1*f* and 1*e* and prevent the downward movement of the outer cap 3 so that the closure remains in the child-resistant mode. The upper peripheral edge portion 1*b* on inner cap 1 engaging lugs 3*d* and 3*e* prevents outer cap 3 from moving downwardly during its counter-clockwise rotation except for the area of the openings in edge portion 1*b* formed by the axial extending slots 1*e* and 1*f*. In these open slot areas in edge portion 1*b*, during counter-clockwise rotation of outer cap 3 relative to inner cap 1, the bridge member 6 is positioned to take over the blocking function of upper peripheral edge portion 1*b*, by registering the tops of posts 6*c* with the lower ends of leg members 3*i* and 3*j* thus blocking downward movement of the lugs 3*d* and 3*e* on the outer cap 3 into axial slots 1*e* and 1*f* on the inner cap 1. During the remaining portion of the counter-clockwise rotation of the outer cap 3 the lugs 3*d* and 3*e* after passing over slots 1*e* and if are supported on the upper peripheral edge 1*b* of the inner cap 1 so that the outer cap 3 cannot be pushed downwardly, and the flexible fingers 3*g* and 3*h* flex and snap over posts 6*d* since bridge member 6 is in abutment with stops 1*h* and 1*i*.

Therefore, during counter-clockwise rotation of the outer cap 3 relative to the inner cap 1 the closure cannot be manipulated to the child-resistant mode since such a manipulation is blocked by bridge member 6.

Figure 3:
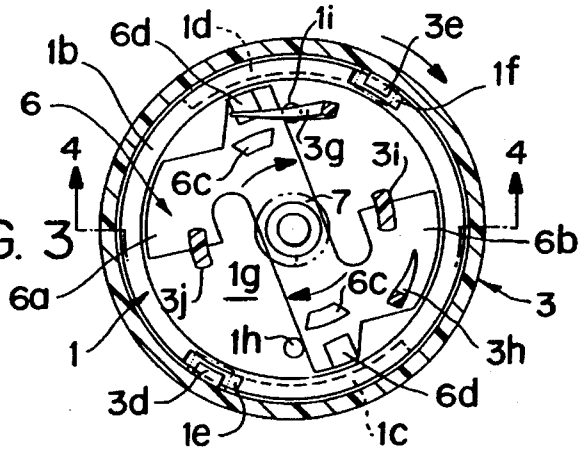
FIG. 3 is a transverse cross-sectional view similar to FIG. 1, showing the bridge member pivoted clockwise into its other stop member and the locking lugs being positioned for manipulating the closure to the non-child-resistant position, the view being taken substantially along line 3—3 of FIG. 4.

To remove the closure from the bottle, the outer cap 3 is rotated in a clockwise direction. During this clockwise movement of the outer cap 3 the flexible finger 3*g* engages the upper end of post 6*d* of the vane portion 6*a*, as shown in FIG. 1, or, depending upon the position of the elements, flexible finger 3*h* engages the upper end of post 6*d* of the vane portion 6*b* (not shown), and the bridge member 6 is rotated in a clockwise direction until the leading edges of the vane portions 6*a* and 6*b* abut the stop members 1*i* and 1*h*, respectively, as shown in FIG. 3. During this rotation of the outer cap 3 and bridge member 6, the posts 6*c* on the bridge member 6 are positioned out of registration and axial alignment with the leg members 3*i* and 3*j* when the lugs 3*d* and 3*e* become aligned with the axially extending slots 1*e* and 1*f* in the inner cap 1, so that the outer cap 3 can be pushed downwardly, as shown in FIG. 5, and then turned in a counter-clockwise direction to move the lugs 3*d* and 3*e* into abutment with the ends of their respective circumferential slots 1*c* and 1*d*, as shown in phantom lines in FIG. 5, whereby the inner and outer caps 1 and 3 become interconnected so that the closure can be unscrewed and removed from the neck 2 of the bottle by further counter-clockwise rotation of the outer cap 3.

In order to provide an indication to the user that the clockwise movement of the outer cap 3 relative to the inner cap 1 has reached the position where the depending leg members 3*i* and 3*j* are free of the posts 6*c*, and the lugs 3*d* and 3*e* are aligned with the respective slots 1*e* and 1*f*, the lower end of the skirt portion 3*b* of the outer cap 3 is provided with a pair of diametrically disposed inwardly extending protuberances 3*k* adapted to engage a pair of diametrically disposed outwardly extending protuberances 1*k* integral with the lower skirt portion of the inner cap 1. When protuberances 3*k* and 1*k* engage, a resistance to further rotation of outer cap 3 on inner cap 1 is felt by the user, but the protuberances are of such a size that with slight increased rotative pressure protuberances 3*k* can pass over protuberances 1*k* for continued rotation of outer cap 3 on inner cap 1, thus contributing to the child-resistant aspect of the closure. The protuberances 3*k* and 1*k* can pass over each other during both clockwise and counter-clockwise rotation of outer cap 3.

When replacing the closure on the bottle, the inner cap 1 is threaded onto the neck 2 of the bottle by turning the closure in a clockwise direction. Continued turning of the closure in the clockwise direction to tighten the closure on the bottle will result in the outer cap 3 being rotated relative to the inner cap 1 by lugs 3*d* and 3*e* sliding clockwise in the pair of circumferentially extending slots 1*c* and 1*d* until the lugs 3*d* and 3*e* abut the end walls of the axially extending slots 1*e* and 1*f* to tighten inner cap 1 on the bottle, whereupon the spring 7 biases the outer cap 3 upwardly from the position shown in full lines in FIG. 5 to the position shown in FIG. 4, so that the closure is once again in the child-resistant mode.

From the above description it will be readily apparent to those skilled in the art that the condition indicating child-resistant closure of the present invention having the inner cap, outer cap and rotating bridge member requires fewer molded plastic parts, and is more user-friendly for adults than heretofore.

The terms and expressions which have been employed herein are used as terms of description and not of limitation, and there is no intention, in the use of such terms and expressions, of excluding any equivalents of the features shown and described, or portions thereof, but it is recognized that various modifications are possible within the scope of the invention claimed.

I claim:

1. A child-resistant closure comprising an inner cap having a top wall and adapted to be threadably mounted on a container, an outer cap having a top wall and mounted on said inner cap, means interconnecting the inner and outer caps, whereby the inner cap is captivated within the outer cap and freely rotatable relative to each other during a child resistant mode of the closure but connectable to each other for removal from the container during a non-child-resistant mode of the closure, a vertically extending post integral with the top wall of the inner cap, a bridge member freely rotatable on said post, said bridge member being rotatable between a first position prohibiting the inner and outer caps from being interconnected for removal from the container and a second position permitting the manipulation of the outer cap relative to the inner cap for interconnecting the inner and outer caps for removal of the closure from the container.

2. A child-resistant closure according to claim 1, including at least one stop member integral with the inner cap to limit the rotation of the bridge member between said first and second positions.

3. A child-resistant closure according to claim 1, wherein said top wall of said outer cap has an inner surface, and depending flexible fingers integral with the inner surface of the top wall of the outer cap, said depending fingers being engageable with said bridge member during rotation of said outer cap for rotating said bridge member alternately between said first and second positions.

4. A child-resistant closure according to claim 3, in which said top wall of said outer cap has an inner surface, depending leg members integral with said inner surface of said top wall of said outer cap and alignable with said bridge member when said bridge member is rotated to the first position to prevent the outer cap and inner cap from being interconnected for removal of the closure from the container, and said depending leg members positioned out of alignment with said bridge member when said bridge member is rotated to the second position to permit interconnection of said inner and outer caps for removal of said closure from the container.

5. A child-resistant closure according to claim 4, in which said depending flexible fingers and said depending leg members are connected on different radii from said vertically extending post on said inner surface of said top wall.

6. A child-resistant closure according to claim 1, wherein the bridge member comprises a rotor having oppositely extending vane portions, a vertically-extending post integral with each vane portion, and depending leg members integral with the inner surface of the top wall of the outer cap and being axially aligned with the vertically extending posts on the vane portions when the bridge member is rotated to the first position whereby the ends of the posts and the leg member are adapted to abut each other to prevent the outer cap and inner cap from being interconnected for removal of the closure from the container, the depending leg members and vane posts being positioned out of axial alignment when the bridge member has been rotated to the second position, whereby the inner and outer caps can be interconnected for removal of the closure from the container.

7. A child-resistant closure according to claim 6, depending flexible fingers integral with said inner surface of said top wall of said outer cap, said depending fingers being engageable with said bridge member during rotation of said outer cap for rotating said bridge member alternately between said first and second positions.

8. A child-resistant closure according to claim 1, and spring means positioned coaxial with said vertically extending post and extending between said bridge member and said top wall of said outer cap, whereby said inner and outer caps are biased in spaced relation to each other.

9. A child-resistant closure according to claim 1, wherein the top wall of the outer cap is spaced above the top wall of the inner cap, the vertically extending post on the top wall of the inner cap being wholly contained in the space between the outer and inner caps when the closure is in the child-resistant mode, said post extending through the top wall of the outer cap when the closure is in the non-child-resistant mode, whereby the post is visible outside the closure to indicate the non-child-resistant mode of the closure.

10. A child-resistant closure according to claim 9, including spring means positioned coaxial with the vertically extending post and mounted between the top wall of the inner cap and top wall of the outer cap whereby the inner and outer caps are biased in spaced relationship to each other.

11. A condition indicating child-resistant closure comprising, an inner cap adapted to be threadably mounted on a container, an outer cap mounted on said inner cap, means interconnecting the inner and outer caps, whereby the inner cap is captivated within the outer cap and they are moveable axially and freely rotatable relative to each other, the inner cap having a top wall, a peripheral edge provided in the top of said inner cap, said outer cap having a top wall and a depending side wall, radially inwardly extending lugs on the inner wall surface of the outer cap side wall, said lugs engaging the peripheral edge portion on the top of the inner cap whereby the outer cap is held in an upward position on said inner cap, and the cap is in a child-resistant mode, wherein the outer cap is freely rotatable on the inner cap, a vertically extending indicating post secured to the top wall of the inner cap, an opening provided in the top wall of the outer cap in alignment with said indicating post, said indicating post being wholly contained within the space between the top walls of the inner and outer caps and therefore not visible outside of the cap, to thereby indicate the child-resistant mode of the closure, slot means provided in the side wall of said inner cap communicating with the peripheral edge portion on the inner cap, said lugs being receivable in the slot means, whereby the outer cap is moved axially downwardly into interconnecting engagement with the inner cap, and the closure is in a non-child-resistant mode, said indicating post extending outwardly of the top wall of the outer cap through said opening, to thereby be visible outside the closure to indicate the non-child-resistant mode of the closure, and a bridge member supported on the top wall of the inner cap and being freely rotatable on the indicating post, said bridge member being moveable between a first position prohibiting the inner and outer caps from being interconnected for removal from the container and a second position permitting the manipulation of the outer cap relative to the inner cap for interconnecting the inner and outer caps for removal of the closure from the container.

* * * * *